US010799040B2

(12) United States Patent
Jones et al.

(10) Patent No.: US 10,799,040 B2
(45) Date of Patent: Oct. 13, 2020

(54) DRY FOG DIFFUSER FOR COLD SERVICE CASE

(71) Applicant: Corrigan Corporation of America, Gurnee, IL (US)

(72) Inventors: Paul Jones, Ingleside, IL (US); Eric Ellingson, Libertyville, IL (US)

(73) Assignee: Corrigan Corporation of America, Gurnee, IL (US)

( * ) Notice: Subject to any disclaimer, the term of this patent is extended or adjusted under 35 U.S.C. 154(b) by 235 days.

(21) Appl. No.: 16/119,193

(22) Filed: Aug. 31, 2018

(65) Prior Publication Data

US 2020/0069079 A1 Mar. 5, 2020

(51) Int. Cl.

| | |
|---|---|
| ***F24F 6/14*** | (2006.01) |
| ***B01F 3/04*** | (2006.01) |
| ***B05B 1/00*** | (2006.01) |
| ***A47F 3/04*** | (2006.01) |
| ***B05B 7/24*** | (2006.01) |

(52) U.S. Cl.

CPC ..... *A47F 3/0495* (2013.01); *B01F 3/04049* (2013.01); *B05B 1/00* (2013.01); *B05B 7/2491* (2013.01); *F24F 6/14* (2013.01)

(58) Field of Classification Search

CPC .. F24F 6/14; A47L 3/0495; B05B 1/00; B01F 3/04; B01F 3/04049

See application file for complete search history.

(56) References Cited

U.S. PATENT DOCUMENTS

| | | | | |
|---|---|---|---|---|
| 3,990,427 | A | 11/1976 | Clinebell | |
| 4,179,900 | A | 12/1979 | Corrigan | |
| 4,190,875 | A | 2/1980 | Smart et al. | |
| 4,678,125 | A | 7/1987 | Elston | |
| 5,762,661 | A | 6/1998 | Kleinberger et al. | |
| 5,893,520 | A | 4/1999 | Elkas | |
| 6,132,497 | A | 10/2000 | Conklin | |
| 8,430,379 | B2 | 1/2013 | Goldstein | |
| 10,508,821 | B2 * | 12/2019 | Jones | F24F 6/14 |
| 2019/0120510 | A1 * | 4/2019 | Kleinberger | F24F 6/14 |

* cited by examiner

*Primary Examiner* — Robert A Hopkins

(74) *Attorney, Agent, or Firm* — Wood, Phillips, Katz, Clark & Mortimer

(57) ABSTRACT

A dry fog diffuser assembly for use in a refrigerated space comprises a base having an adapter for connection to a high-pressure water supply in a range of 600 to 1,000 psi. The nozzle has an orifice in the range of 0.003-0.012 inches to produce a fine water vapor. A riser operatively connects the nozzle to the adapter to space the nozzle from the base. A housing is mounted to the base and encloses the nozzle. The housing defines an open space below the nozzle providing an air inlet to the interior of the housing. A diffuser comprises a stainless-steel elbow having an inlet end and an outlet end. The inlet end is mounted to the housing. An inner surface of the diffuser has a roughness of at least Ra25, where water vapor from the nozzle is diffused in the elbow and the diffuser produces a dry fog exiting at the outlet end.

20 Claims, 4 Drawing Sheets

DRY FOG DIFFUSER FOR COLD SERVICE CASE

CROSS-REFERENCE TO RELATED APPLICATIONS

Not Applicable.

FIELD OF THE INVENTION

This application relates to humidification systems and, more particularly, to a humidification system including a dry fog diffuser for use in a cold service case.

BACKGROUND OF THE INVENTION

Various enclosed spaces benefit from the control of humidity levels. Some refrigerated spaces may require that humidity be added to the space. One application is in a so-called cold service case used, for example, in a grocery store to display food products such as meat and seafood. Refrigerated air is supplied into the case to maintain a desired temperature in the case. However, the refrigerated air has a drying effect on the food products displayed in the cold service case.

Advantageously, humidity should be added to the cold service case. Higher humidity levels result in less product shrinkage and longer shelf life. The products hold their marketability. Moreover, a gently rolling fog can attract customers and protect the display from drying effects of refrigeration. Perishable items maintain a fresh, natural appeal. As a result, food products can stay in a cold service case longer, including overnight. Moreover, in seafood cases, use of ice can be minimized or eliminated.

There exist various known systems for increasing humidity levels in a cold service case. One known system uses an air atomizing nozzle which produces a fine vapor fog. The nozzle is placed below the product allowing the dry fog to billow up around the meat, seafood or other products. However, the air where the nozzle is placed may be below freezing. Also, such a system requires a compressor which may produce undesirable noise levels.

Another known system uses ultrasonic nebulization transducers to produce a dry fog for cold service cases. Such a system is quiet. However, ultrasonic nebulization is difficult to operate without creating bacterial issues in the required warm water bath. Such systems require frequent cleaning and are expensive.

This application describes improvements in humidification systems.

SUMMARY OF THE INVENTION

As described herein, a humidification system uses a dry fog diffuser.

In one aspect of the invention, a dry fog diffuser assembly for use in a refrigerated space comprises a base having an adapter for connection to a high-pressure water supply in a range of 600 to 1,000 psi. The nozzle has an orifice in the range of 0.003-0.012 inches to produce a fine water vapor. A riser operatively connects the nozzle to the adapter to space the nozzle from the base. A housing is mounted to the base and encloses the nozzle. The housing defines an open space below the nozzle providing an air inlet to the interior of the housing. A diffuser comprises a stainless-steel elbow having an inlet end and an outlet end. The inlet end is mounted to the housing. An inner surface of the diffuser has a roughness of at least Ra25, where water vapor from the nozzle is diffused in the elbow and the diffuser produces a dry fog exiting at the outlet end.

It is a feature that the outlet end is at about a 90-degree or a 45-degree angle relative to a horizontal plane.

It is another feature that the elbow has a diameter in a range of 1.25 inches to 1.5 inches and may be about 1.375 inches.

It is an additional feature that the nozzle has an aluminum oxide smooth orifice surface.

It is yet another feature that the inner surface of the elbow has a No. 4 finish roughened to provide surface energy greater than 72 dynes/cm.

It is a further feature that the size of the open space is selected to control amount of fog.

It is yet another feature that the adapter is operatively connected to a water filter for connection to the water supply.

It is yet a further feature to provide a support secured to the housing for mounting the diffuser assembly to a refrigerated case.

There is disclosed in accordance with another aspect a dry fog humidification system for use in a refrigerated space comprising a pump connected between a water supply and a water header to provide a high-pressure water supply in a range of 600-1,000 psi. A control selectively operates the pump. A plurality of diffuser assemblies are provided. Each diffuser assembly comprises a base having an adapter for connection to the water header. A nozzle has an orifice in the range of 0.003 to 0.012 inches to produce a fine water vapor. A riser operatively connects the nozzle to the adapter to space the nozzle from the base. A housing is mounted to the base and encloses the nozzle. The housing defines an open space below the nozzle providing an air inlet to the interior of the housing. A diffuser comprises a stainless-steel elbow having an inlet end and an outlet end. The inlet end is mounted to the housing. An inner surface of the diffuser has a roughness of at least Ra25, wherein water vapor from the nozzle is diffused in the elbow and the diffuser produces a dry fog exiting at the outlet end.

Further features and advantages will be readily apparent from the specification and from the drawings.

DETAILED DESCRIPTION

The disclosed humidification system uses a dry fog diffuser to maintain humidity at desired levels.

Figure 1:
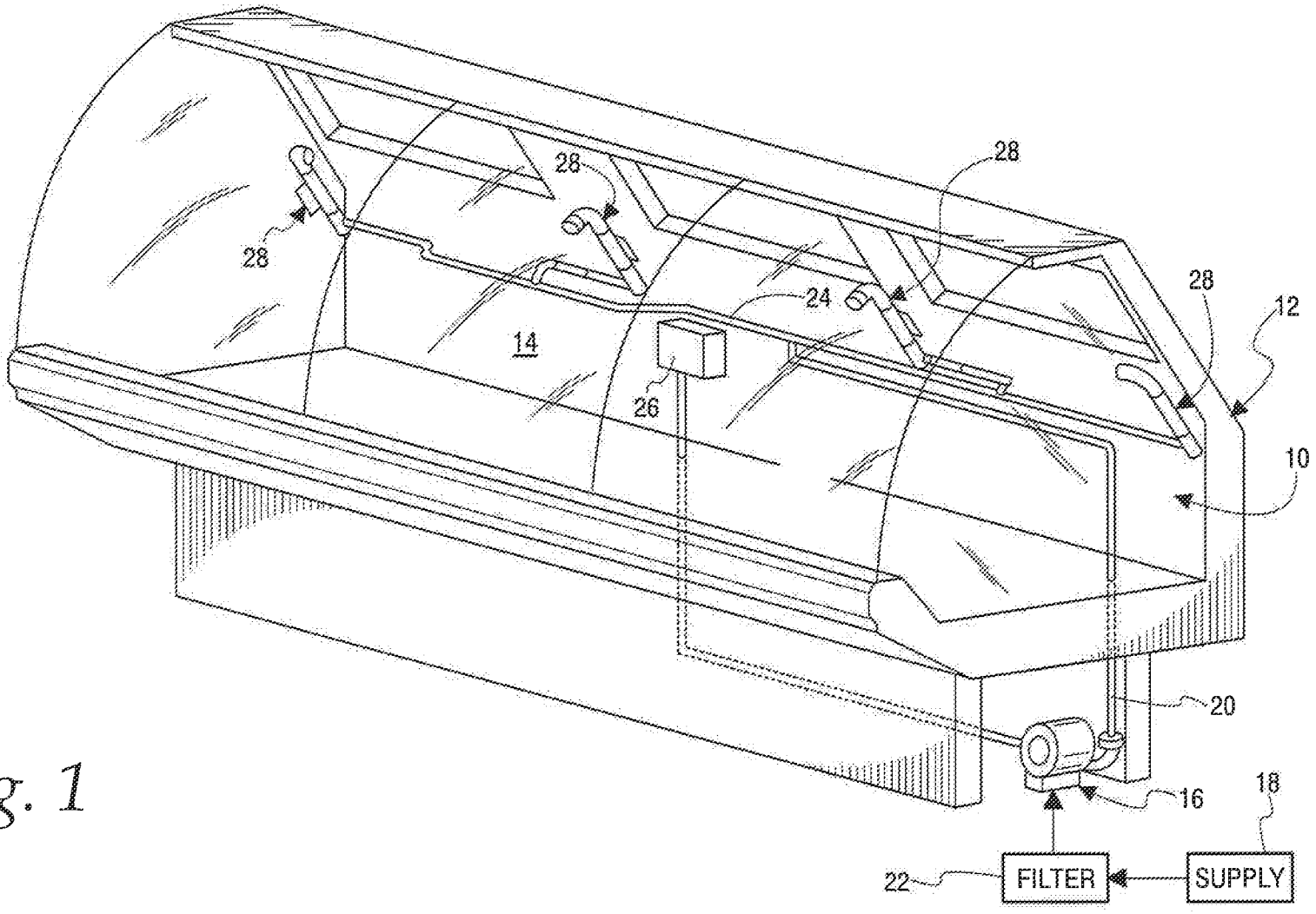
FIG. 1 is a perspective view of a cold service case having a dry fog humidification system.

Referring initially to FIG. 1, a dry fog humidification system 10 is illustrated for use in a cold service case 12 housing a refrigerated space 14. The cold service case 12 is particularly adapted to display meat or seafood products, or the like, which need to be refrigerated and for which there is a desire to add humidity to the case 12. This invention is not directed to the particular cold service case 12 illustrated herein. Instead, the invention is particularly directed to the humidification system 10 used therein. As such, the illustrated cold service case 12 is by way of example only and the humidification system 10 could be adapted for use with various different types of refrigerated spaces from warehouses, to coolers, to service cases.

The humidification system 10 comprises a pump 16. The pump 16 is connected via a filter 22 to a water supply 18 such as a conventional utility supply. The pump 16 is connected through an outlet line 20 to a manifold 24. The pump 16 may take any known form and is advantageously adapted to provide a high-pressure water supply in a range of 600-1,000 psi. The filter 22 is used to pre-filter the water supply with a 45-micron filter to reduce the probability of nozzle clogging. A control 26 controls operation of the pump 16. The control 26 includes flexible settings so that preferred humidity levels are easily achieved. As will be apparent, the control 26 could be a timer or a humidity control, or the like, as necessary or desired.

The humidification system 10 includes a plurality of diffuser assemblies 28 each secured to the cold service case 12 and operatively coupled to the manifold 24. The diffuser assemblies 28 use pressurized water with atomizing nozzles, as described below, to produce a dry fog responsive to the pump 16 being turned on. Particularly, the humidification system 10 quietly produces a visible rolling dry fog to raise and maintain the relative humidity in the refrigerated space 14 of the cold service case 12.

Figures 2, 3:
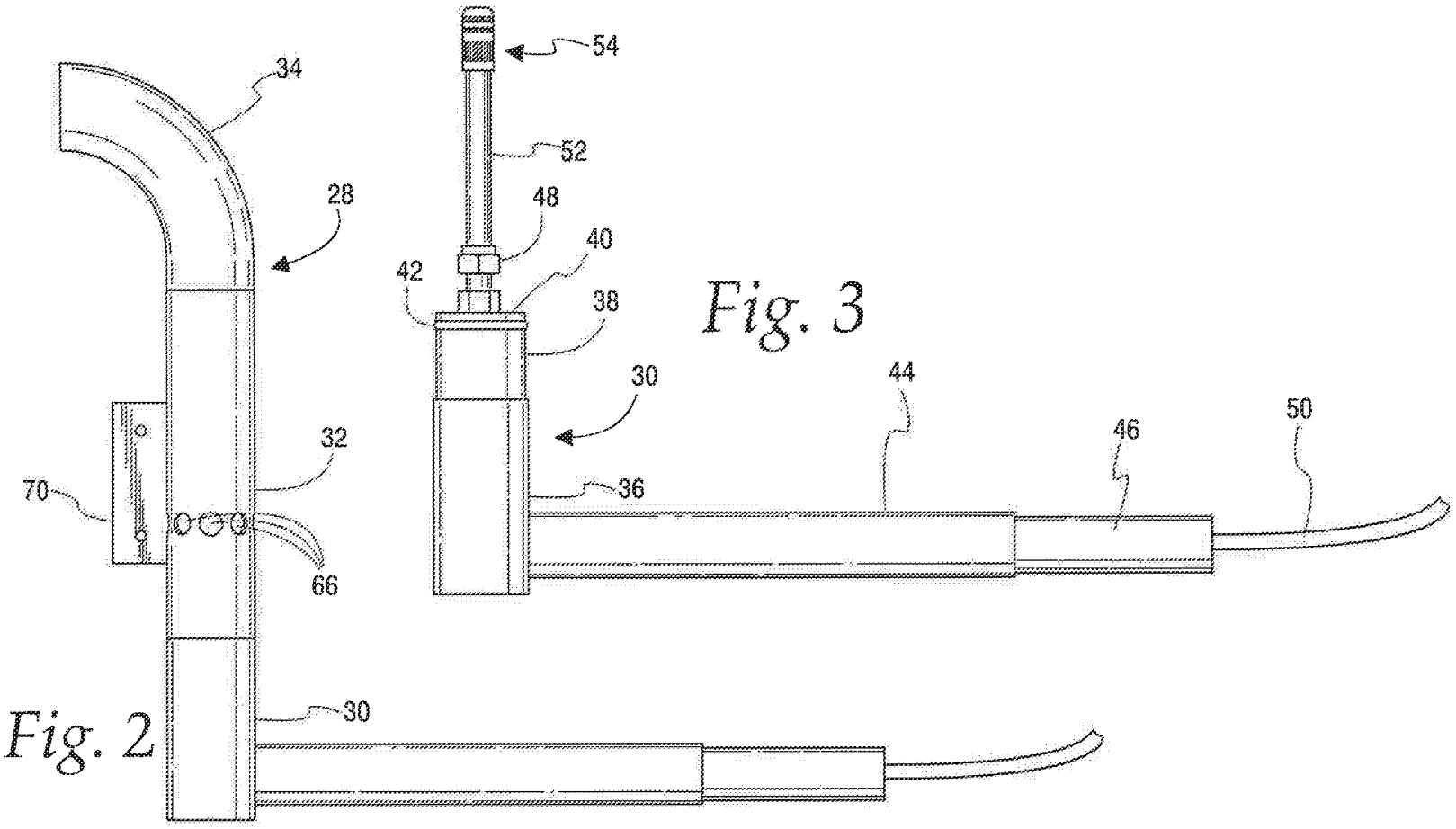
FIG. 2 is a side view of a diffuser assembly used in the cold service case of FIG. 1.
FIG. 3 is a side view, similar to FIG. 2, of the diffuser assembly with a housing and diffuser removed.

Referring to FIG. 2, one of the diffuser assemblies 28 is illustrated in greater detail. The diffuser assembly 28 comprises a base 30, a housing 32 and a diffuser 34.

The base 30 is illustrated in FIG. 3. The base 30 comprises a vertical cylindrical wall 36 having a narrowed neck 38 closed by a top wall 40. An O-ring 42 is provided around the neck 38, just below the top wall 40. An elongate horizontal cylindrical wall 44 extends radially outwardly from the vertical cylindrical wall 36 and has a narrowed distal end 46. A tube adapter 48 is threadably connected to the top wall 40. An elongate flexible tube 50 is connected to the tube adapter 48 within the cylindrical wall 36 in a known manner and extends through the cylindrical walls 36 and 44 exiting the distal end 46, as shown. The flexible tube 50 is operatively connected to the manifold 24, in any known manner, using appropriate fittings and tubular elements, as necessary for the particular application.

A riser 52 is connected to the tube adapter 48 and extends upwardly therefrom. A nozzle 54 is connected at a top end of the riser 52. The nozzle 54 is of conventional design having an orifice in the range of 0.003 inches to 0.0012 inches, and advantageously in the range of 0.006 to 0.008 inches to produce a fine water vapor or mist. Preferably, the nozzle 54 includes an aluminum oxide smooth orifice surface, such as ruby, for pattern and longevity. The nozzle 54 may be, for example, a 0.006 inch or 0.008 inch ruby misting nozzle supplied by Misting Direct, or a 0.006 inch or 0.008 inch misting and cooling nozzle supplied by AmFog. These comprise high quality misting nozzles which create an extremely fine mist of fine particles in the micron range. In fact, a high percentage of droplets produced are less than 50 microns in size.

Figure 6:
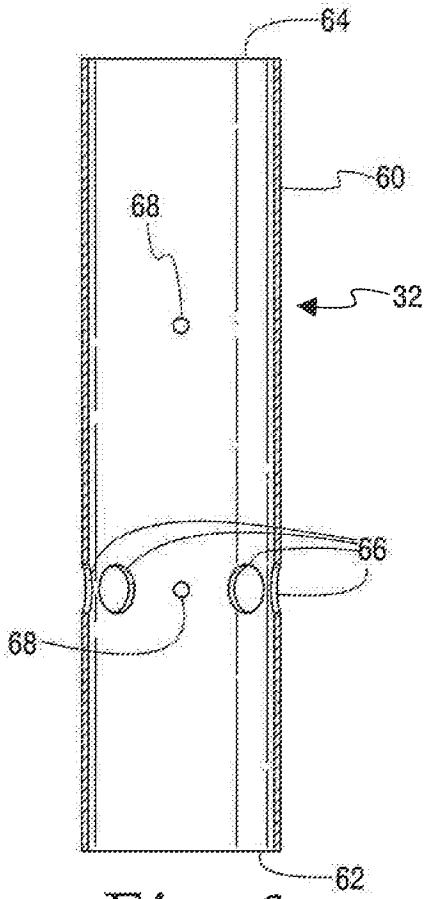
FIG. 6 is a sectional view of the housing of FIG. 5.
Figure 5:
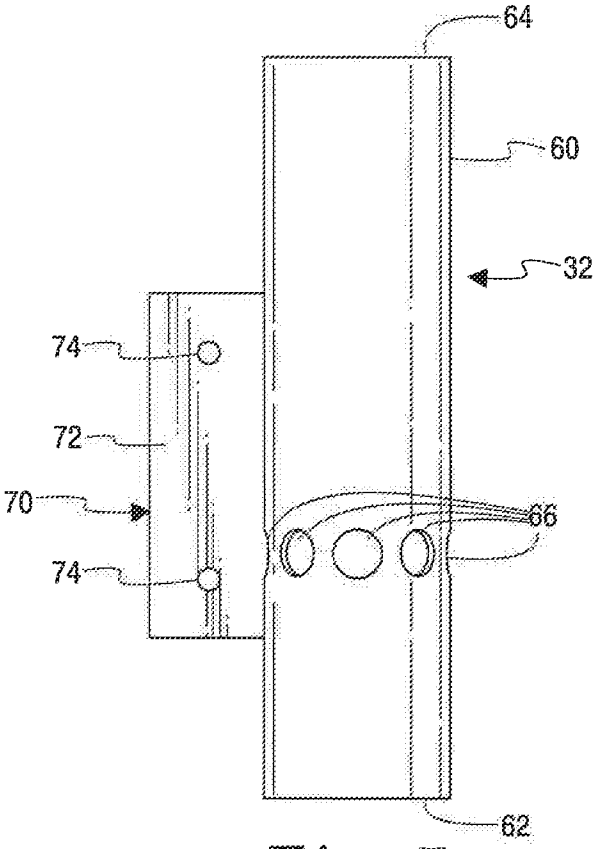
FIG. 5 is a side view of the housing of the diffuser assembly of FIG. 2.
Figure 4:
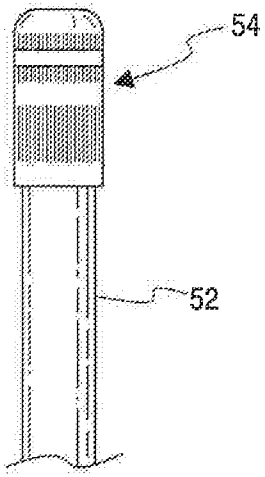
FIG. 4 is a detailed view of a nozzle end of the diffuser assembly.

Referring to FIGS. 5 and 6, the housing 32 is illustrated in greater detail. The housing 32 comprises an elongate cylindrical wall 60 having a lower end 62 and an upper end 64. A plurality of larger openings 66 of uniform size are provided through the cylindrical wall 60. The openings 66 are circumferentially spaced from one another proximate the lower end 62. A pair of smaller openings 68 are provided in the cylindrical wall 60 spaced evenly between the lower end 62 and upper end 64 and one another. The lower of the smaller openings 68 is aligned with the larger openings 66. The smaller opening 68 are used for securing the cylindrical wall 60 to a support 70 comprising a plate 72. The plate 72 has a pair of openings 74 for receiving fasteners to secure the housing 32 to a cold service case, or the like, in use.

Figure 7:
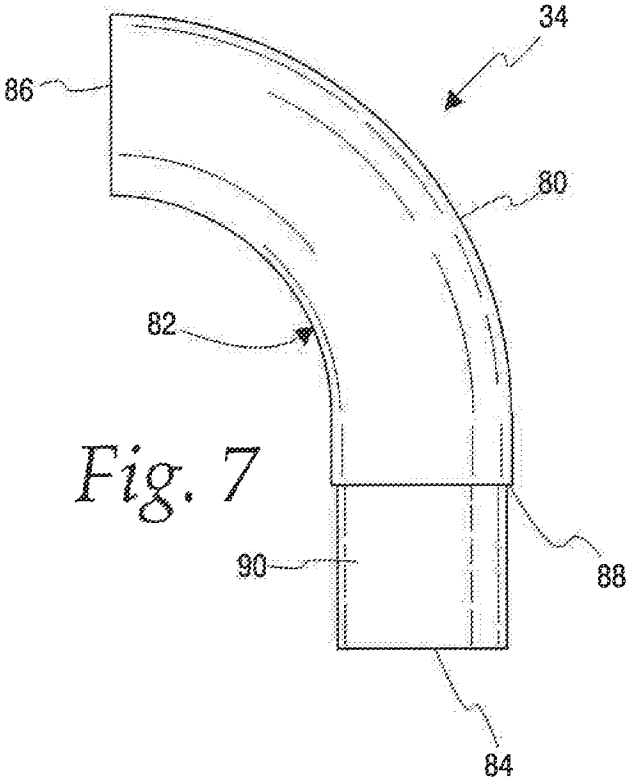
FIG. 7 is a side view of the diffuser of the diffuser assembly of FIG. 2.

Referring to FIG. 7, the diffuser 34 comprises a tube 80 having a bend 82. In the illustrated embodiment, the bend 82 is a 90-degree bend so that the diffuser 34 comprises an elbow. As will be apparent, the elbow could have a different bend, such as, for example, 45 degrees. The tube 80 comprises an inlet end 84 and an outlet end 86. The tube 80 is narrowed from a shoulder 88 to the inlet end 84 to be telescopically received in the housing cylindrical wall 60.

Figure 8:
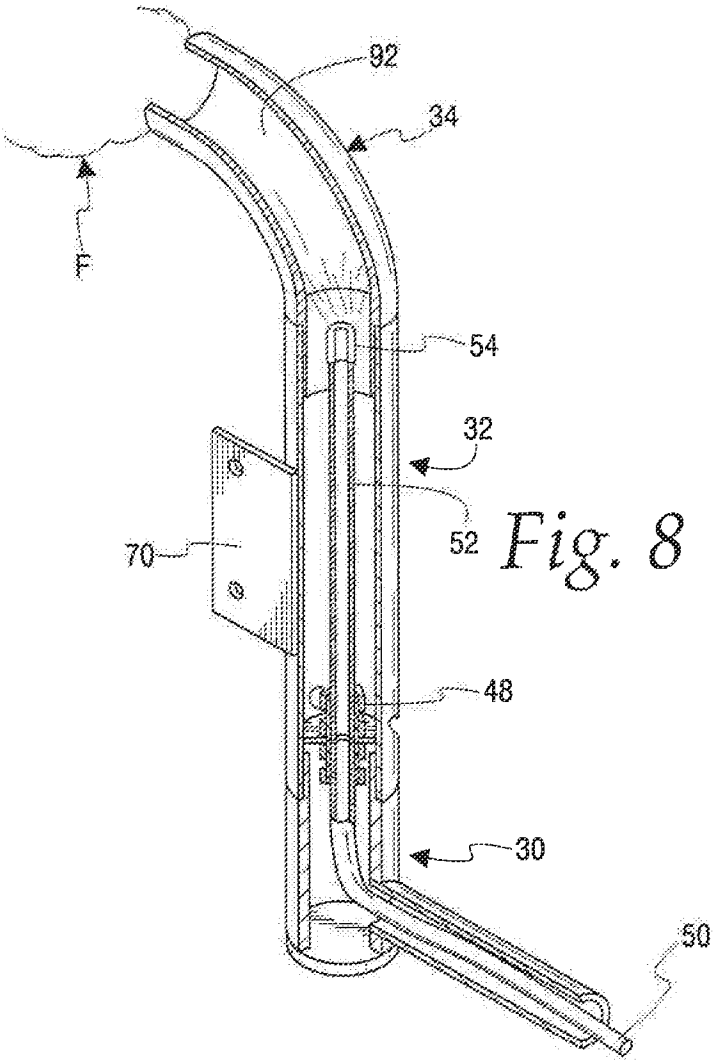
FIG. 8 is a perspective view, partially cut away, view showing operation of the diffuser assembly of FIG. 2 for producing a dry fog.

At least the diffuser 34 is constructed of stainless-steel. Advantageously, the housing 32 and base 30 are also constructed of stainless-steel for sanitary purposes. In accordance with the invention, the diffuser tube 80 has an inside diameter in a range of about 1.25 inches to 1.5 inches with about 1.375 inches being preferred. In the illustrated embodiment of the invention, the housing cylindrical wall 60 has an outer diameter of 1.5 inches and an inner diameter of about 1.402 inches. The outer diameter of the diffuser neck 90 is about 1.4 inches to be received in the housing cylindrical wall upper end 64, as shown in FIG. 8. In the illustrated embodiment, the housing cylindrical wall 60 is about 6 inches long with the larger openings 66 being spaced about two inches from the lower end 62 and the upper of the openings 68 about two inches from the upper end 64. The housing lower end 62 is telescopically received on the neck 38 of the base 30. As such, the base 30, housing 32 and diffuser 34 comprise a continuous cylindrical structure of uniform diameter, with a top elbow. The length of the riser 52 is selected so that the nozzle 54 is positioned proximate the housing upper end 64. The nozzle 54 is spaced about 4 inches above the larger openings 66. With the housing 32 mounted to the base 30, the larger openings 66 are just above the base top wall 40. The openings 66 function as both drains and as air inlets.

In the illustrated embodiment of the invention, the base 30, the housing 32 and the diffuser 34 are made of pharmaceutical or food grade piping which is very smooth by design. The nozzle 54 produces small particles of water in the micron range. However, with smooth piping, the atomized water tends to bead up. To counteract this, an inner wall 92 of the diffuser 30 is roughened with a fine grit sandpaper, Emery cloth, scrub pads or the like. Particularly, the typical pharmaceutical and food piping comes with a No. 4 finish. A No. 4 finish has short, parallel polishing lines obtained by mechanically polishing a No. 3 finish with gradually finer abrasive. The final finish can be anywhere between 120 and 320 grit. The surface roughness is typically Ra25 microinches or less. This No. 4 finish is roughened with a greater than 120 grit media. This results in the parallel lines no longer being visible and the surface energy is increased so that water will not bead up. The surface tension of water at 25° C. is 72 dynes/cm, so that the resulting surface energy is greater than 72 dynes/cm as the water totally wets the surface.

As described, air ingress through the larger openings 66 is below the nozzle 54. A dry fog flow is created and is voluminous because the airflow is coming from behind and concentrically oriented with the nozzle mist flow. These larger openings 66 can be left wide open to provide a strong column of fog or the air can be restricted by selecting a desired opening size or by selectively closing the openings 66, in any known manner, to create a slow, rolling smoky fog. Particularly, the amount of fog coming out of the diffuser outlet end 86 depends on the amount of air allowed to enter below the nozzle 54.

The inner surface energy of the stainless-steel diffuser tube 80 is important. If the dry fog is allowed to bead up on the inner wall 92, then large water droplets will be dispersed at the meat or seafood which is undesirable. This is avoided owing to use of the roughened surface having a roughness of at least Ra25. The diffuser 34 separates the larger water particles (those that hit the side wall 92, and those too heavy to be released) and drains them away out the openings 66.

Thus, there is described in accordance with the invention a dry fog diffuser assembly 28 for use in a refrigerated space 14. The diffuser assembly 28 comprises a base 30 having an adapter 48 for connection to a high-pressure water supply. A nozzle 54 is adapted to produce a fine water vapor. A riser 52 connects the nozzle 54 to the adapter 48 to space the nozzle from the base 30. A housing 32 is mounted to the base 30 and encloses the nozzle 54. The housing 32 defines an open space via openings 66 below the nozzle 54 to provide an air inlet to the interior of the housing 32. A diffuser 38 comprises a stainless-steel tube 80 having a bend 82 between an inlet end 84 and an outlet end 86. The inlet end 84 is mounted to the housing 32. An inner surface of the diffuser has a roughness of at least Ra25. Water vapor from the nozzle 54 is diffused in the tube 80 and a diffuser produces a dry fog F exiting at the outlet end 86.

It will be appreciated by those skilled in the art that there are many possible modifications to be made to the specific forms of the features and components of the disclosed embodiments while keeping within the spirit of the concepts disclosed herein. Accordingly, no limitations to the specific forms of the embodiments disclosed herein should be read into the claims unless expressly recited in the claims. Although a few embodiments have been described in detail above, other modifications are possible. Other embodiments may be within the scope of the following claims.

The invention claimed is:

1. A dry fog diffuser assembly for use in a refrigerated space, comprising:

a base having an adapter for connection to a high-pressure water supply in a range of 600-1000 psi;

a nozzle having an orifice in the range of 0.003-0.012 inches to produce a fine water vapor;

a riser operatively connecting the nozzle to the adapter to space the nozzle from the base;

a housing mounted to the base and enclosing the nozzle, the housing defining an open space below the nozzle providing an air inlet to the interior of the housing; and a diffuser comprising a stainless-steel elbow having an inlet end and an outlet end, the inlet end being mounted to the housing, an inner surface of the diffuser having a roughness of at least Ra25, wherein water vapor from the nozzle is diffused in the elbow and the diffuser produces a dry fog exiting at the outlet end.

2. The dry fog diffuser assembly of claim 1 wherein the outlet end is at about a 90-degree angle relative to a horizontal plane.

3. The dry fog diffuser assembly of claim 1 wherein the elbow has a diameter in a range of 1.25 inches to 1.5 inches.

4. The dry fog diffuser assembly of claim 1 wherein the elbow has a diameter of about 1.375 inches.

5. The dry fog diffuser assembly of claim 1 wherein the nozzle has an aluminum oxide smooth orifice surface.

6. The dry fog diffuser assembly of claim 1 wherein the inner surface of the elbow has a No. 4 finish roughened to provide surface energy greater than 72 dynes/cm.

7. The dry fog diffuser assembly of claim 1 wherein size of the open space is selected to control amount of fog.

8. The dry fog diffuser assembly of claim 1 wherein the adapter is operatively connected to a water filter for connection to the water supply.

9. The dry fog diffuser assembly of claim 1 further comprising a support secured to the housing for mounting the diffuser assembly to a refrigerated case.

10. The dry fog diffuser assembly of claim 1 wherein the outlet end is at about a 45-degree angle relative to a horizontal plane.

11. A dry fog humidification system for use in a refrigerated space comprising:

a pump connected between a water supply and a water header to provide a high-pressure water supply in a range of 600-1000 psi;

a control selectively operating the pump;

a plurality of diffuser assemblies, each diffuser assembly comprising, a base having an adapter for connection to the water header;

a nozzle having an orifice in the range of 0.003-0.012 inches to produce a fine water vapor;

a riser operatively connecting the nozzle to the adapter to space the nozzle from the base;

a housing mounted to the base and enclosing the nozzle, the housing defining an open space below the nozzle providing an air inlet to the interior of the housing; and a diffuser comprising a stainless-steel elbow having an inlet end and an outlet end, the inlet end being mounted to the housing, an inner surface of the diffuser having a roughness of at least Ra25, wherein water vapor from the nozzle is diffused in the elbow and the diffuser produces a dry fog exiting at the outlet end.

12. The dry fog humidification system of claim 11 wherein the outlet end is at about a 90-degree angle relative to a horizontal plane.

13. The dry fog humidification system of claim 11 wherein the elbow has a diameter in a range of 1.25 inches to 1.5 inches.

14. The dry fog humidification system of claim 11 wherein the elbow has a diameter of about 1.375 inches.

15. The dry fog humidification system of claim 11 wherein the nozzle has an aluminum oxide smooth orifice surface.

16. The dry fog humidification system of claim 11 wherein the inner surface of the elbow has a No. 4 finish roughened to provide surface energy greater than 72 dynes/cm.

17. The dry fog humidification system of claim 11 wherein size of the open space is selected to control amount of fog.

18. The dry fog humidification system of claim 11 wherein the adapter is operatively connected to a water filter for connection to the water supply.

19. The dry fog humidification system of claim 11 further comprising a support secured to the housing for mounting the diffuser assembly to a refrigerated case.

20. The dry fog humidification system of claim 11 wherein the outlet end is at about a 45-degree angle relative to a horizontal plane.

* * * * *